US005459123A

United States Patent [19]

Das

[11] Patent Number: 5,459,123

[45] Date of Patent: Oct. 17, 1995

[54] FERROELECTRIC ELECTRONICALLY TUNABLE FILTERS

[76] Inventor: Satyendranath Das, P.O. Box 574, Mt. View, Calif. 94042-0574

[21] Appl. No.: 225,320

[22] Filed: Apr. 8, 1994

[51] Int. Cl.[6] ..... H01P 1/207; H01P 1/208; H01B 12/02

[52] U.S. Cl. ..... 505/210; 505/700; 505/866; 333/209; 333/212; 333/99 S

[58] Field of Search ..... 333/208, 209, 333/212, 99 S; 505/204, 210, 700, 701, 866

[56] References Cited

U.S. PATENT DOCUMENTS 2,924,792 2/1960 Gyorgy ..... 333/208 X
5,032,811 7/1991 Nishikawa et al. ..... 333/208

FOREIGN PATENT DOCUMENTS 251903 10/1989 Japan ..... 333/227
1201927 12/1985 U.S.S.R. ..... 333/208
1317525 6/1987 U.S.S.R. ..... 333/208

*Primary Examiner*—Benny T. Lee

[57] ABSTRACT

A cylindrical cavity is loaded with a ferroelectric rod and is resonant at the dominant mode. The loaded cylidrical cavity is a band pass filter. As a bias voltage is applied across the ferroelectric rod, its permittivity changes resulting in a new resonant frequency for the loaded cylindrical cavity. The ferroelectric rod is operated at a temperature slightly above its Curie temperature. The loaded cylindrical cavity is kept at a constant designed temperature. The cylindrical cavity is made of conductors, a single crystal high Tc superconductor including YBCO and a single crystal dielectric, including sapphire and lanthanum aluminate, the interior conducting surfaces of which are deposited with a film of a single crystal high Tc superconductor. Embodiments also include waveguide single and multiple cavity type tunable filters. Embodiments also include tunable band reject filters.

18 Claims, 7 Drawing Sheets

FERROELECTRIC ELECTRONICALLY TUNABLE FILTERS

FIELD OF INVENTION

The present invention relates to filters for electromagnetic waves and more particularly, to RF filters which can be controlled electronically.

DESCRIPTION OF THE PRIOR ART

In many fields of electronics, it is often necessary to receive the signal of selected frequencies. Commercial YIG tuned filters are available.

Ferroelectric materials have a number of attractive properties. Ferroelectrics can handle high peak power. The average power handling capability is governed by the dielectric loss of the material. They have low switching time (such as 100 nS). Some ferroelectrics have low losses. The permittivity of ferroelectrics is generally large, and as such the device is small in size. The ferroelectrics are operated in the paraelectric phase, i.e. slightly above the Curie temperature. The active part of the ferroelectric high Tc superconductor filter can be made of thin films, and can be integrated with other monolithic microwave/RF devices. Inherently they have a broad bandwidth. They have no low frequency limitation as contrasted with ferrite devices. The high frequency operation is governed by the relaxation frequency, such as 95 GHz for strontium titanate, of the ferroelectric material. The loss of the ferroelectric high Tc superconductor RF phase shifter is low with ferroelectric materials with a low loss tangent. A number of ferroelectric materials are not subject to burnout. Depending on trade off studies in an individual case, the best type of filter can be selected.

SUMMARY OF INVENTION

Das used a composition of polycrystalline barium titanate, of stated Curie temperature of 20 degrees C. and of polythene powder in a cavity and observed a shift in the resonant frequency of the cavity with an applied bias voltage. S. Das, "Quality of a Ferroelectric Material," IEEE Trans. MTT-12, pp. 440–448, July 1964.

The general purpose of this invention is to provide an electronically controlled tunable filter which embraces the advantage of similarly employed conventional devices such as the YIG tuned filter. This invention, in addition, reduces the conductive losses.

To attain this, the present invention contemplates the use of a cylindrical cavity containing a ferroelectric rod whose permittivity is dependent on the electric field in which it is immersed. On the application of a bias field, the permittivity of the ferroelectric rod changes resulting in changing the resonant frequency of the cylindrical cavity.

It is an object of this invention to provide a voltage controlled ferroelectric tunable filter which uses lower control power and is capable of handling high peak and average powers than conventional electronically tunable filters. High Tc superconductor materials can handle a power level of 0.5 MW. Another objective of this invention is to build reciprocal tunable filters. Another objective is to build a tunable filter with a low loss. Another objective is to build tunable filters operating from a low frequency to at least 95 GHz.

These and other objectives are achieved in accordance with the present invention which comprises of a cylindrical cavity having an input coil and an output coil. The cylindrical cavity is loaded with a ferroelectric material and the loaded cavity is tuned to the dominant mode. Strontium titanate and lead titanate composition has a low loss at a high Tc, currently 77 to 105K and increasing, superconducting temperature. The ferroelectric material is used slightly above its Curie temperature. Another ferroelectric material is $KTa_{1-X}Nb_XO_3$ (KTN). The permittivity of the ferroelectric rod changes with the changes in the applied bias electric field. This changes the frequency of the cylindrical cavity. To reduce the value of the permittivity, the composition of strontium titanate and lead titanate can be mixed with polythene powder to make a composition.

The cylindrical cavity is made of conductors, made of a single crystal high Tc superconductor material including YBCO, and made of a single crystal dielectric material, including sapphire and lanthanum aluminate, the interior conducting surfaces of which are deposited with a high Tc superconductor material.

Waveguide tunable filters are also part of this invention. Individual cavities, waveguides, irises and flanges are connected together by brazing or by a similar means.

In summary, three embodiments of cavities are invented, one with room temperature conductors, and the second and the third with high Tc superconductors. The figures for cavities with room temperature conductors and with single crystals of high Tc superconductors are identical. The means for a constant temperature 99 includes a room temperature and a high Tc superconducting temperature.

With these and other objectives in view, as will hereinafter more fully appear, and which will be more particularly pointed out in the appended claims, reference is now made to the following description taken in connection with accompanying diagrams.

DETAILED DESCRIPTION OF THE PREFERRED EMBODIMENT

Figure 1:
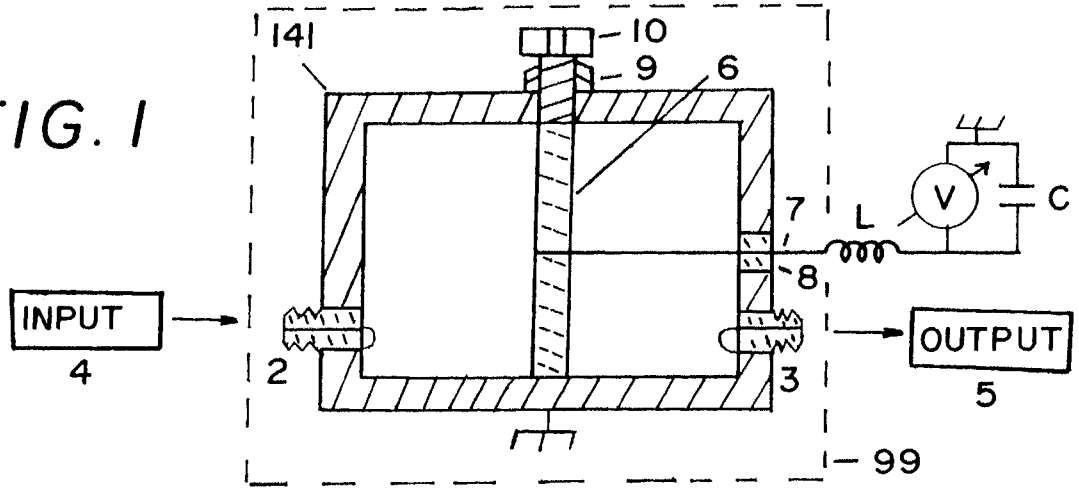
FIG. 1 is a cross-section of a cylindrical cavity loaded with a ferroelectric material biased in the middle.

Now referring to FIG. 1, an embodiment of the present invention is depicted. The loaded cylindrical cavity is 141 and is tuned to the dominant mode. The input coupling coil is 2 and the output coupling coil is 3. The ferroelectric material is 6 and is biased in the middle. The ferroelectric material is a cylindrical or a rectangular rod. The bias wire is 7. An LC filter is provided to prevent any leakage of the RF energy. The ferroelectric rod acts as a variable capacitor loading the cylindrical cavity. A screw and a nut 9 is provided to keep the ferroelectric material in place during any vibration of the filter. The bias wire is taken through a dielectric or a ferroelectric insulator 8. The cylindrical cavity 141, loaded with the ferroelectric material 6, acts as a band pass filter. With the application of a bias voltage to the ferroelectric material, the permittivity of the material changes resulting in a different resonant frequency for the cavity. Increasing changes in the permittivity produce increasing shifts in the resonant frequency of the cylindrical cavity. A table can be prepared with the values of the bias voltage V versus the resonant frequency of the cavity. A commercial microprocessor can be used to provide any specific resonant frequency desired. Each cavity of each embodiment of this invention is operated in its dominant resonant frequency.

Figure 2:
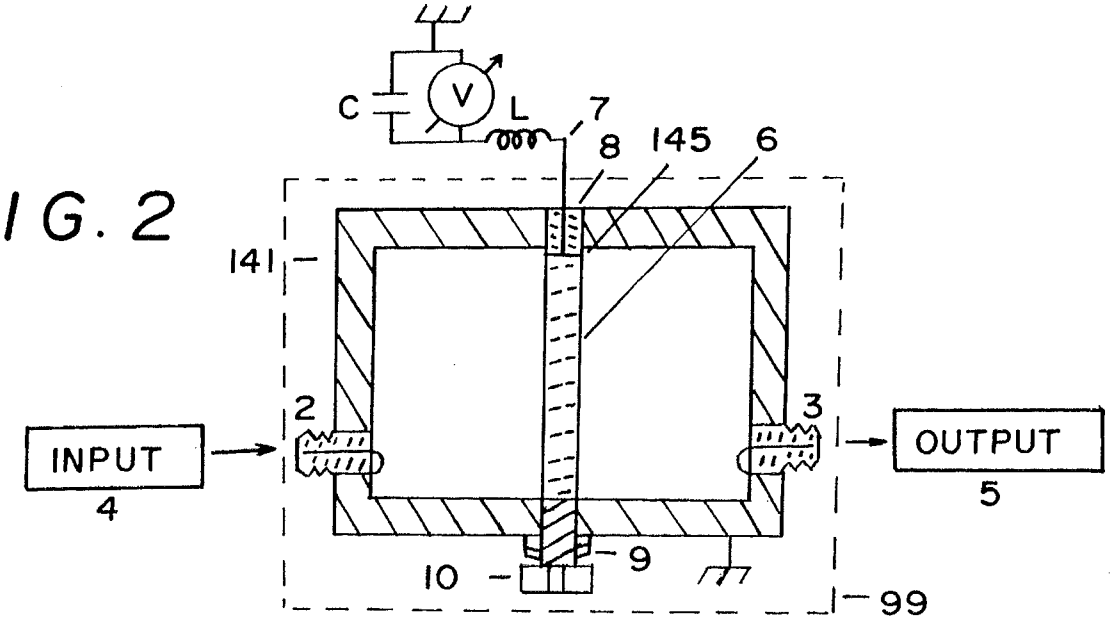
FIG. 2 is a cross-section of cylindrical cavity loaded with a ferroelectric material biased at the end.

In FIG. 2 is depicted a cylindrical cavity with a ferroelectric material biased at one end. The cylindrical cavity is 141. The bias V to the ferroelectric material 6 is fed at one end through 7. The input coil is 2 and the output coil is 3. The electrode for applying a bias is 145. A screw 10 and a nut 9 are provided to keep the ferroelectric rod 6 in place. An LC filter is provided to prevent any leakage of RF energy.

The cylindrical cavities of FIG. 1 and FIG. 2 are made of a room temperature conductor or a single crystal high Tc superconductor material including YBCO.

Figure 3:
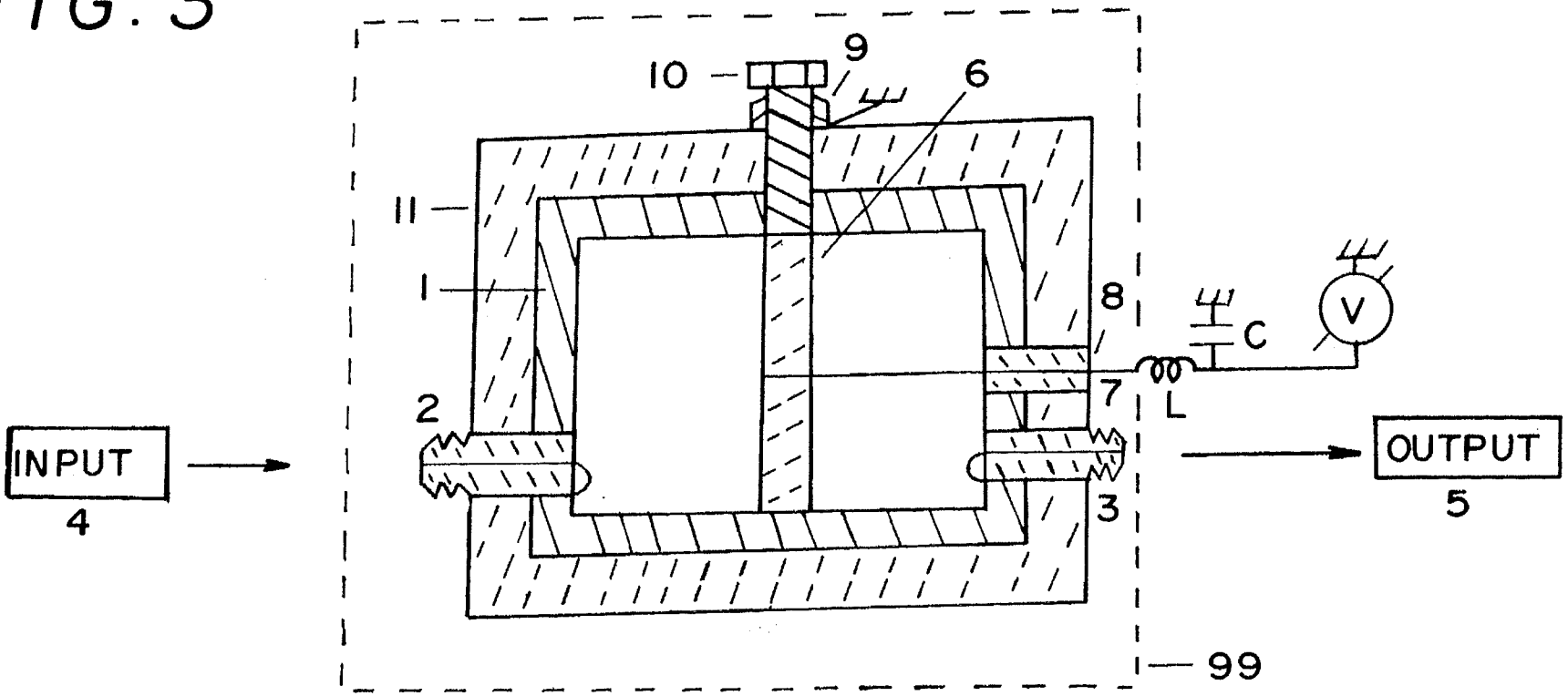
FIG. 3 is a cross-section of a cylindrical cavity made of a single crystal dielectric material.

In FIG. 3 is depicted a cylindrical cavity made of a single crystal dielectric material 211, including sapphire, lanthanum aluminate, having interior conducting surfaces 1 which are coated with a film of a single crystal high Tc superconductor material including $YBa_2Cu_3O_7$ (YBCO). A ferroelectric rod is 6. The input connector is 2 and the output connector is 3. A screw 10 and a nut 9 are provided to keep the ferroelectric rod in place. A bias voltage V is applied through an LC filter and a biasing wire 7. The bias insulator is 8.

Figure 4:
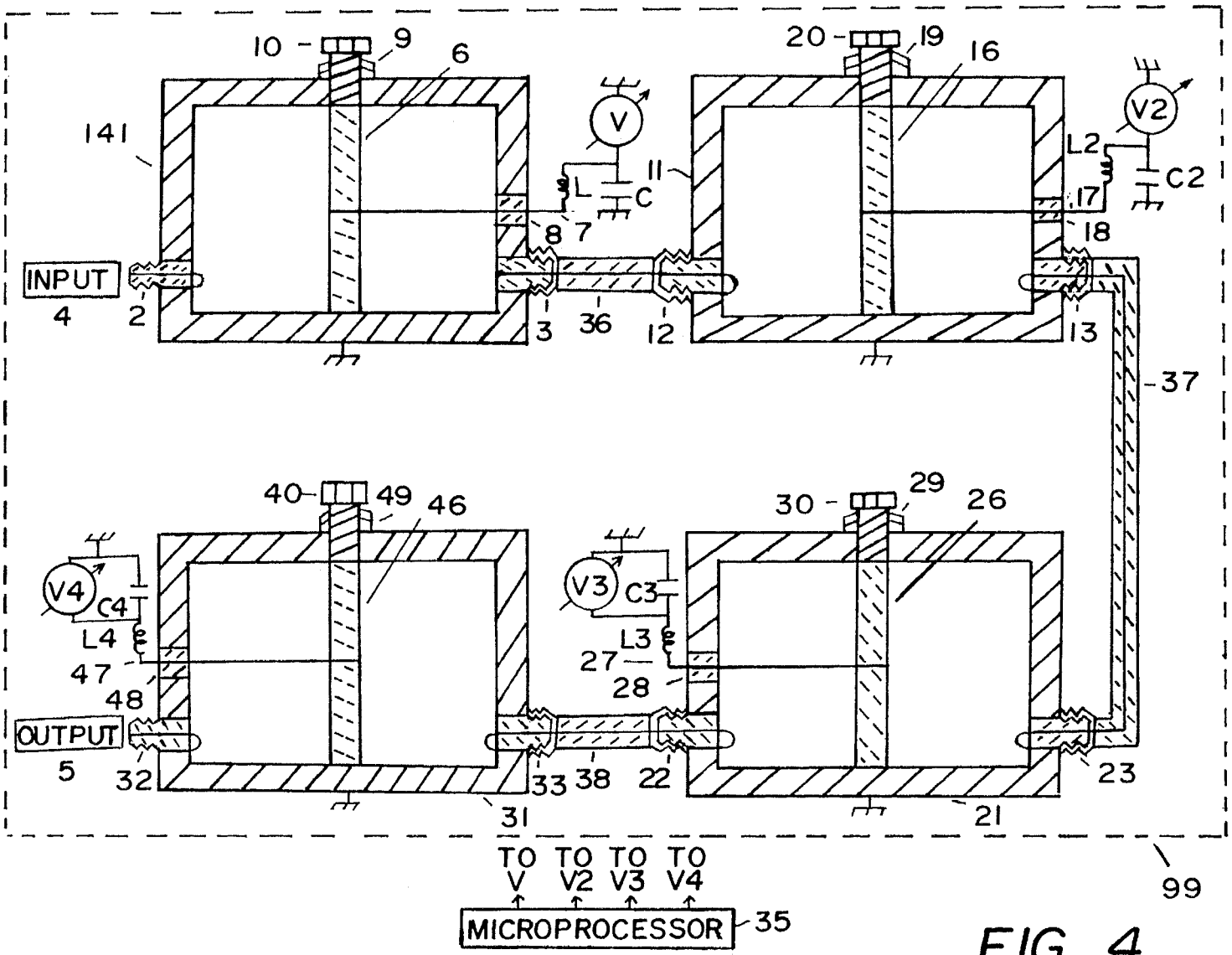
FIG. 4 is a cross-section of a four cylindrical cavity band pass tunable filter.

In FIG. 4 is depicted another embodiment of this invention. FIG. 4 depicts a tunable four cylindrical cavity band pass filter, with more attenuation outside the pass band or a larger bandwidth than is obtained with a one cylindrical cavity.

The four cylindrical cavities are 141, 11, 21 and 31. The ferroelectric rods placed at the centers of the cavities, are 6, 16, 26 and 46 Each cylindrical cavity, loaded with a ferroelectric rod, is independently tuned to the dominant mode. The ferroelectric rods are kept in place by screws 10, 20, 30, and 40 and bolts 9, 19, 29 and 49. The bias wires are 7, 17, 37 and 47. The bias wires are insulated by 8, 18, 28 and 48. The filters, to prevent any leakage of RF, are LC, L2C2, L3C3 and L4C4. The bias voltages are V, V2, V3 and V4. The coaxial cables connecting the cavities are 36, 27 and 38. The length of each coaxial cable is typically three quarters of a wavelength. The input connectors, to the four cylindrical cavities, are 2, 12, 23, and 33. The output connectors, of the four cylindrical cavities, are 3, 13, 22 and 32. The input is 4 and the output is 5.

With the application of a bias voltage to the ferroelectric rod its permittivity changes and the cylindrical cavity is tuned to a new resonant frequency. A look up table is prepared, for each cylindrical cavity, giving the resonant frequency of each cavity versus the applied bias voltage. A microprocessor 35 is used to control each bias voltage V, V2, V3 and V4 to obtain the required resonant frequency of each cavity.

Figure 5:
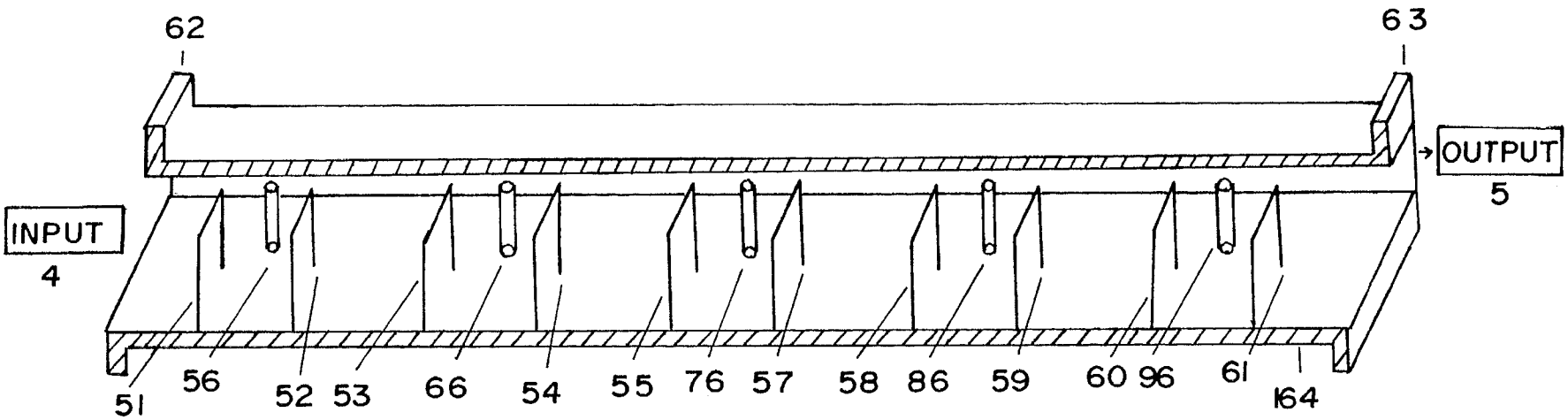
FIG. 5 is a pictorial diagram of a five waveguide cavity band pass tunable filter.

In FIG. 5 is depicted another embodiment of this invention. FIG. 5 depicts a five normal height waveguide tunable cavity filter with more attenuation outside the pass band or a broader band than is obtained with one waveguide cavity.

The waveguide cavities are formed with inductive irises. FIG. 5 shows one half of the irises. There are five pair of half irises 51, 52; 53, 54; 55, 57; 58, 59; and 60, 61 in FIG. 5. The rectangular waveguide cavities are loaded with rectangular or cylindrical ferroelectric rods 56, 66, 76, 86 and 96. Each ferroelectric rod is biased separately in the middle. The ferroelectric rods can be biased at one end. Each cavity, loaded with a ferroelectric rod, is tuned to the dominant mode. On the application of a bias voltage, the permittivity of the ferroelectric rod changes and the rectangular cavity is tuned to a new resonant frequency. A look up table is prepared, for each cavity, for an applied bias voltage level against the resonant frequency. A microprocessor can separately control the bias voltage of each ferroelectric rod and tune each of the five cavities to its desired resonant frequency.

The waveguide is 164. The flanges are 62 and 63. The input is 4 and the output is 5.

Figure 6:
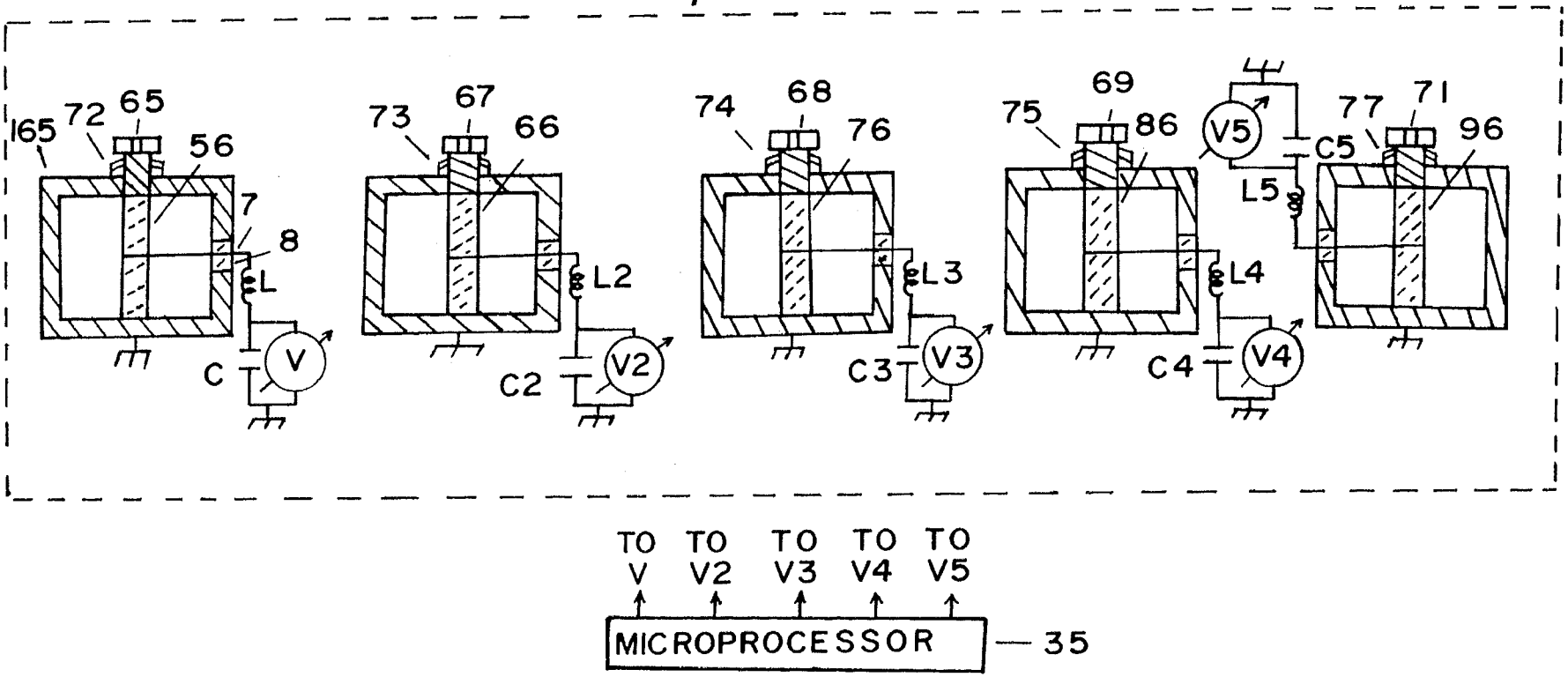
FIG. 6 is a biasing arrangement of the ferroelectric rods of FIG. 5.

In FIG. 6 is depicted the biasing arrangement of the five cavity filter depicted in FIG. 5. The ferroelectric rods 56, 66, 76, 86 and 96 are preferably biased in the middle. The cavity is 165. The ferroelectric rods 56, (56, 76, 86 and 96 are kept in place by screws 65, 67, 68, 69 and 71 and nuts 72, 73, 74, 75 and 77 respectively. Filters LC, L2C2, L3C3, L4C4 and L5C5 prevent any leakage of RF. The voltage sources V, V2, V3, V4 and V5 provide bias voltage to the five ferroelectric rods. Each cavity is calibrated and a look up table is prepared with the resonant frequency versus the applied bias voltage. Frequency of each resonant cavity is set separately with a microprocessor 35. Appropriate selection of the resonant frequencies of the cavities provide (1) a broadband bandpass tunable filter or (2) a narrowband bandpass tunable filter with a larger attenuation, outside the passband, than that can be obtained with a single cavity filter. Five cavities are shown as an example. Smaller or larger number of cavities are used to meet any specific requirement. The cavities, waveguides, flanges and irises are made of conductors and a single crystal high Tc superconductor. Waveguide sections, irises and flanges are connected together by brazing or by a similar means. A tunable filter is operated at a constant temperature appropriately above the Curie temperature of the ferroelectric material. The tunable filters are designed for being kept at a constant room temperature or a high superconducting Tc. The chamber or a cryocooler 99 is used to keep the tunable filters at a constant room temperature or at a constant high superconducting Tc.

Figure 7:
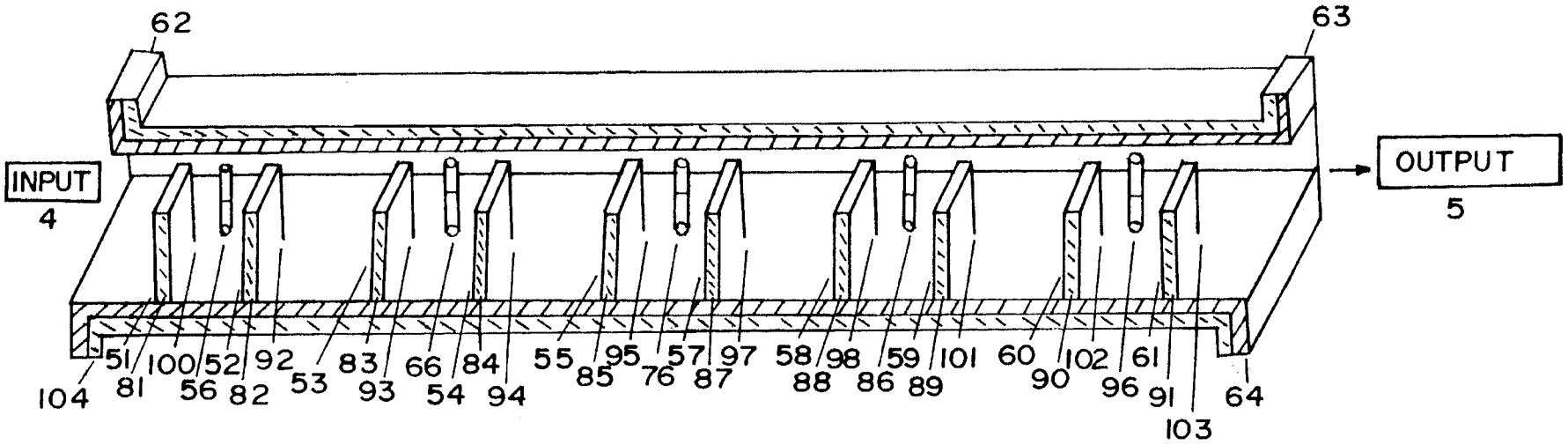
FIG. 7 is a pictorial diagram of a five waveguide cavity, made of a single crystal dielectric, bandpass tunable filter.

In FIG. 7 is depicted a five waveguide cavity, made of a single crystal dielectric, including sapphire and lanthanum aluminate, tunable band pass filter having interior conducting surfaces on which are deposited a film of a single crystal high Tc superconductor. The waveguide 104 is made of a single crystal dielectric material. The interior conducting surfaces 64 of which are deposited with a film of a single crystal high Tc superconductor. The five pair of half irises 81 82, 83 84, 85 87, 88 89 and 90 91 are made of a single crystal dielectric material. The conducting surfaces 51, 100; 52, 92; 53, 93; 54, 94; 55, 95; 57, 97; 58, 59; 101; and 60, 102; 61, 103 of the half irises are coated with a film of a single crystal high Tc superconductor. The ferroelectric rods are 56, 66, 76, 86 and 96. The flanges are 62 and 63. The input is 4 and the output is 5. The biasing arrangement is similar to that shown in FIG. 6. Each cavity, loaded with a ferroelectric rod, is tuned to the dominant mode. The separation between centers of the cavities is three quarters or an appropriate wavelength.

Figure 8:
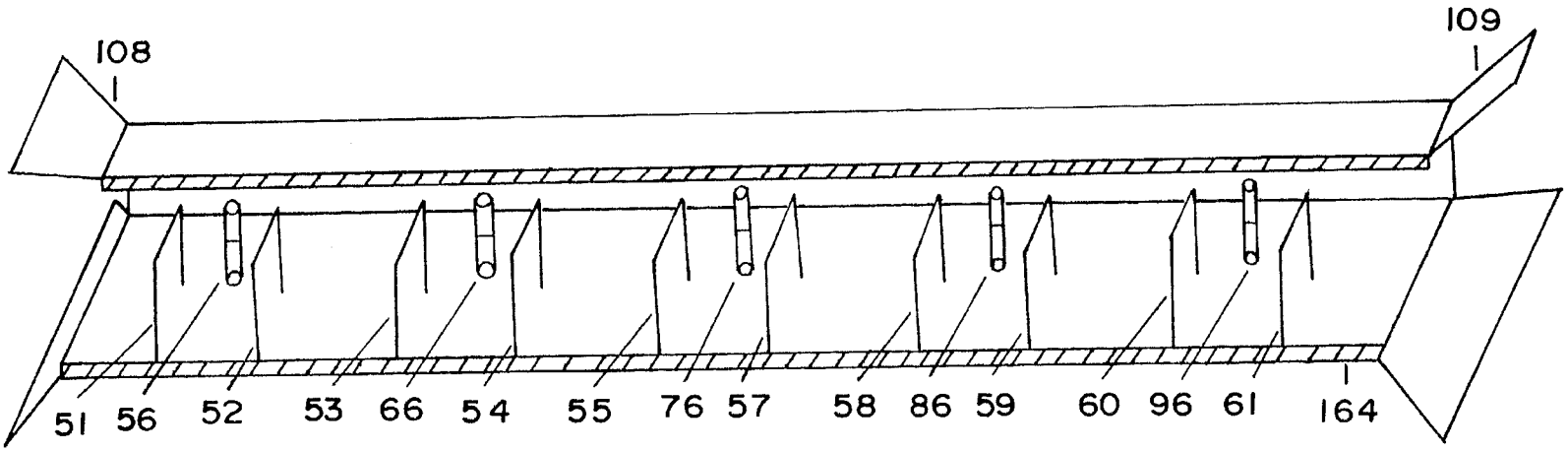
FIG. 8 is a pictorial diagram of a tapered waveguide cavity tunable band pass filter.

In FIG. 8 is depicted five waveguide cavity tunable band pass filter, each waveguide having a reduced height. The reduced height waveguide 164 is made of conductors or a single crystal high Tc superconductor. The tapered sections are 108 and 109. The ferroelectric rods are 56, 66, 76, 86 and 96. The biasing arrangement is similar to that shown in FIG. 6. The half irises are 51 52, 53 54, 55 57, 58 59 and 60 61. Each cavity, loaded with a ferroelectric rod, is tuned to the dominant mode. The separation between the centers of cavities is three quarters or an appropriate wavelength. Each reduced height waveguide cavity can be tuned to the same or a staggered frequency.

Figure 9:
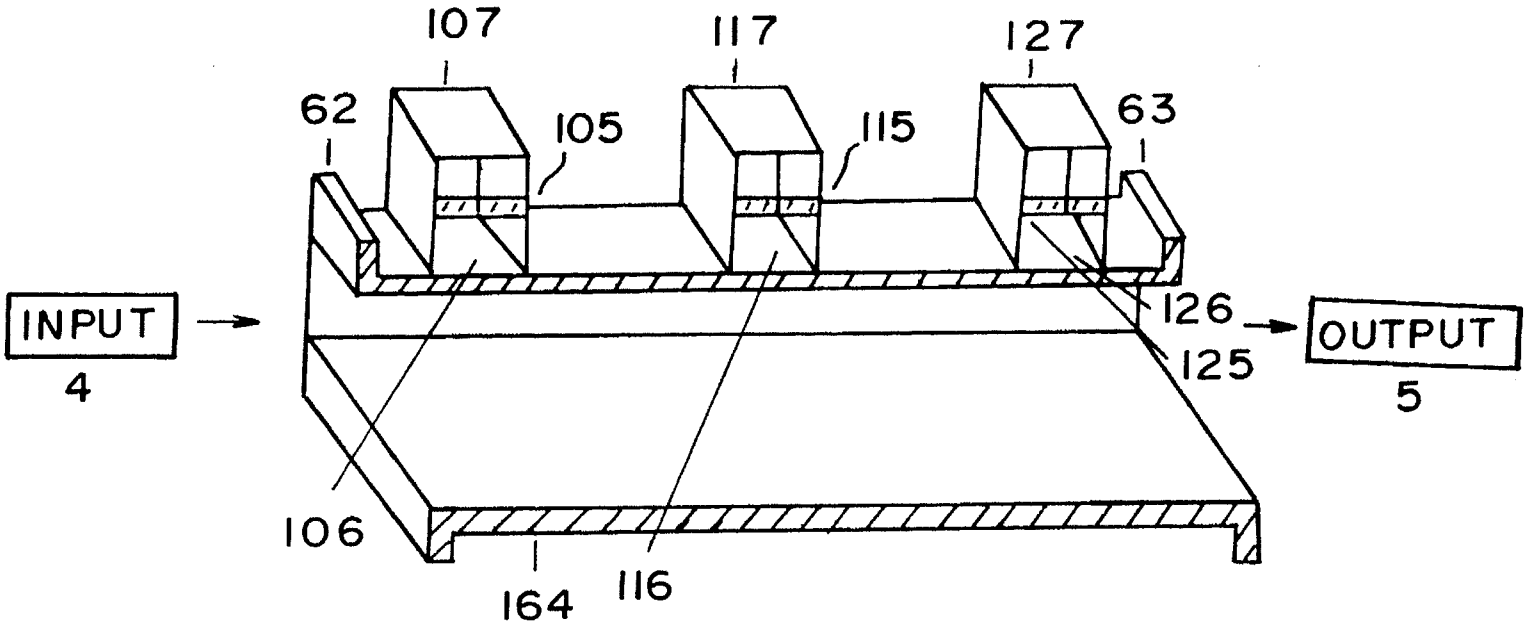
FIG. 9 is a pictorial diagram of a waveguide cavity band reject tunable filter.

In FIG. 9 is depicted a three waveguide cavity band reject tunable filter. The main waveguide is 164 and is made of room temperature conductor or a single crystal high Tc superconductor. The three waveguide cavities, on the broad wall, are 107, 117 and 177. The half irises are 106, 116 and 126. The waveguide cavities are loaded with ferroelectric rods 105, 115 and 125. The flanges are 62 and 63. The biasing arrangement is similar to that shown in FIG. 6 except with three ferroelectric rods. Each cavity is tuned, loaded with ferroelectric rod, to the dominant mode. The separation between the centers of cavities is three quarters of or an appropriate wavelength. Depending on the requirements, the number of cavities are more or less than shown in the Figures. The frequency of each cavity in each of the FIG. 7, FIG. 8 and FIG. 9 is set independently by controlling its bias voltage through a microprocessor 35. When the cavities, of the band reject filter, are tuned to the same frequency the attenuation at the center of the reject band increases compared to that of a single cavity. When the cavities of the band reject filter are tuned to staggered frequencies, the width of the reject band is increased compared to that of a single waveguide cavity.

The width of the iris controls the impedance and the high power handling capability.

Figure 10:
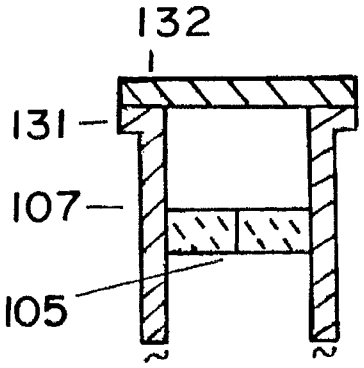
FIG. 10 is an arrangement for introduction of a ferroelectric rod inside a cavity.
Figure 3:
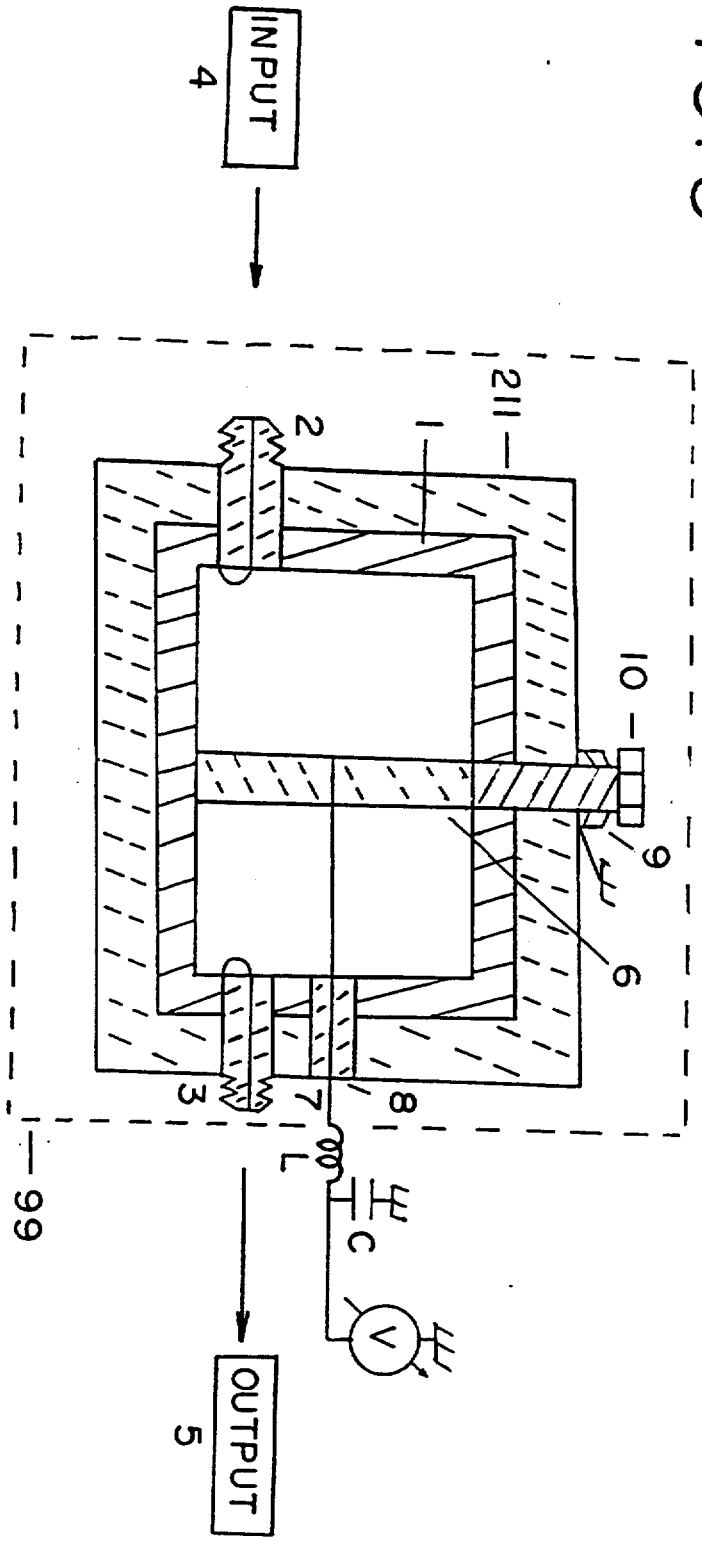

In FIG. 10 is depicted an arrangement for introducing the ferroelectric rod 105 inside the waveguide cavity 107. The cavity end is terminated in a flange 131. The end short circuit is provided by a separate section 132 connected across the end of the cavity after introduction of the ferroelectric rod 105.

The dominant resonant frequency operation of each rectangular waveguide cavity is obtained by making unloaded length of each cavity to one half the wavelength at the operating frequency the length, being changed by the loading due to the iris and the ferroelectric rod. In all figures, the input is 4 and the output is 5, and the means for a constant temperature operation is 99.

It should be understood that the foregoing disclosure relates to only typical embodiment of this invention and that numerous modifications or alternatives may be made therein by those of ordinary skill without departing from the spirit and scope of the inventions set forth in the appended claims. Specifically, the invention contemplates various dielectrics, ferroelectrics, FLCs, high Tc superconductor materials including YBCO, sizes of waveguides and frequencies of operation.

What is claimed is:

1. An RF tunable filter having a cylindrical cavity, a ferroelectric material whose permittivity is dependent on a bias electric field applied thereto and having a Curie temperature, said filter having a nut and a screw, first and second coaxial cables, an input, an output, a dominant resonant frequency, a center, a dominant mode and comprising of:

said cylindrical cavity;

said first coaxial cable being connected to said input;

said second coaxial cable being connected to said output;

a rod comprised of said ferroelectric material, characterized by said permittivity and being placed at said center of said cylindrical cavity and being operated in said dominant mode resonant frequency;

said nut and screw disposed on top of said ferroelectric rod to keep said ferroelectric rod in place in said cylindrical cavity;

means, connected to said ferroelectric rod, to apply said bias electric field to said ferroelectric rod to change the permittivity thereof and said resonant frequency of said cylindrical cavity; and means, with which said tunable filter being associated, for keeping said cylindrical cavity filter at a constant designed temperature appropriately above said Curie temperature of said ferroelectric rod.

2. An RF tunable filter of claim 1 wherein each said ferroelectric rod is comprised of a respective ferroelectric liquid crystal (FLC) material.

3. A high Tc superconducting RF tunable filter, having a ferroelectric material whose permittivity is dependent on an electric field applied thereto and having a Curie temperature, said filter having a single crystal dielectric material, a nut and a screw, first and second coaxial cables, an operating frequency, an input, an output, a center, a dominant mode and comprising of;

said cylindrical cavity comprised of a single crystal dielectric material having conducting surfaces on which are deposited a film of a single crystal high Tc superconductor material;

said first coaxial cable being connected to said input;

said second coaxial cable being connected to said output;

a rod comprised of said ferroelectric material, characterized by said permittivity, being placed at said center of said cylindrical cavity and operating in said dominant mode resonant frequency;

said nut and screw disposed on top of said ferroelectric rod to keep said ferroelectric rod in place in said cylindrical cavity;

means, connected with said ferroelectric rod, to apply said bias electric field to said ferroelectric rod to change the permittivity thereof and said resonant frequency of said cylindrical cavity; and means, with which said tunable filter being associated, to keep the said cylindrical cavity at a constant high Tc superconducting temperature appropriately above said Curie temperature of the ferroelectric material.

4. An RF tunable filter of claim 3 wherein each said ferroelectric rod is comprised of a respective ferroelectric liquid crystal (FLC) material.

5. A high Tc superconductor cylindrical cavity RF tunable filter having a ferroelectric rod, whose permittivity is dependent on an electric field applied thereto and having a Curie temperature, said filter having a nut and a screw, having first and second coaxial cables, a dominant resonant operating frequency, an input, an output, a center, a dominant mode and comprised of;

said cylindrical cavity comprised of a single crystal high Tc superconductor material;

said first coaxial cable being connected to said input;

said second coaxial cable being connected to said output;

a rod comprised of said ferroelectric material, characterized by said permittivity and being placed at said center of said cylindrical cavity and operating in said dominant mode resonant frequency;

said nut and screw disposed on top of said ferroelectric rod to keep said ferroelectric rod in place in said cylindrical cavity;

means, connected with said ferroelectric rod, to apply said bias electric field to said ferroelectric rod to change the permittivity thereof and said resonant frequency of said cylindrical cavity; and means, with which said tunable filter being associated, to keep said cylindrical cavity filter at a constant high Tc superconducting temperature appropriately above said Curie temperature of said ferroelectric rod.

6. An RF tunable band reject filter having rectangular waveguide cavities, ferroelectric rods whose permittivity is dependent on a bias electric field applied thereto and having a Curie temperature, said band reject filter having flanges, first through third irises, an operating frequency, a loaded resonant frequency, an input, an output, centers, a dominant mode and comprising of:

A main rectangular waveguide section having a broad wall;

a first rectangular waveguide cavity having a first inductive iris and being connected to said broad wall of and being separate from said main waveguide;

a first ferroelectric rod, characterized by said permittivity, being placed in said center of said first rectangular waveguide cavity the loaded resonant frequency of which is operated at the dominant mode;

a first means, connected with said first ferroelectric rod, to independently apply a bias electric field to said first ferroelectric rod to change the permittivity thereof and said resonant frequency of said first cavity;

a second rectangular waveguide cavity having a second inductive iris and being connected to said broad wall of and being separate from said main waveguide;

a second ferroelectric rod, characterized by said permittivity, being placed in said center of said second rectangular waveguide cavity the loaded resonant frequency of which being operated at the dominant mode;

a second means, connected to said second ferroelectric rod, to independently apply a bias electric field to said second ferroelectric rod to change the permittivity thereof and said resonant frequency of said second cavity;

a first rectangular waveguide section connected to and providing a separation of a quarter of a guide wavelength long, at an operating frequency of said filter, between said first and said second waveguide cavities and being part of said main waveguide;

a third rectangular waveguide cavity having a third inductive iris being connected to said broad wall of and separate from said main waveguide;

a third ferroelectric rod, characterized by said permittivity , being placed in said center of said third rectangular waveguide cavity the loaded resonant frequency of which being operated at the dominant mode;

a third means, connected to said third ferroelectric rod, to independently apply a bias electric field to said third ferroelectric rod to change the permittivity thereof and said resonant frequency of said third cavity;

a second rectangular waveguide section being connected to and providing a separation of a quarter of a guide wavelength long, at an operating frequency of the filter, between said second and said third waveguide cavities and being a part of said main waveguide;

said rectangular waveguide flanges being connected to said main waveguide at said input and said output respectively;

an output of a microprocessor, being connected to each voltage source, to independently control the level of bias voltages to said first, second and third ferroelectric rods; and means, with which said tunable filter being associated, to keep said rectangular cavity filter at a constant temperature appropriately above said Curie temperature.

7. A high Tc superconducting RF tunable band pass filter having normal height and reduced height rectangular waveguides and waveguide cavities, ferroelectric rods whose permittivity is dependent on a bias electric field applied thereto and having a Curie temperature, said band pass filter having first through tenth irises, flanges, a dominant and a loaded resonant frequency, an input, an output, centers, a dominant mode and comprising of:

a main rectangular waveguide comprised of a single crystal high Tc superconductor;

a first rectangular waveguide cavity comprised of said first and second inductive irises and comprised of a single crystal high Tc superconductor, and being connected to and being a part of said main waveguide;

a first ferroelectric rod, characterized by said permittivity , being placed in said center of said first rectangular waveguide cavity the loaded resonant frequency of which is operated at said dominant mode;

a first means, connected to first ferroelectric rod, to independently apply a bias electric field to said first ferroelectric rod to change the permittivity thereof and said resonant frequency of said first cavity;

a second rectangular waveguide cavity comprised of third and fourth inductive irises and comprised of a single crystal high Tc superconductor, and being connected to and being a part of said main waveguide;

a second ferroelectric rod, characterized by said permittivity, being placed in said center of said second rectangular waveguide cavity the loaded resonant frequency of which being operated at said dominant mode;

a first waveguide section being connected to and providing a separation between said first and said second waveguide cavities and being typically one quarter of a guide wavelength long, at an operating frequency of the filter, and being a part of said main waveguide;

a second means, connected to said second ferroelectric rod, to independently apply a bias electric field to said second ferroelectric rod to change the permittivity thereof and said resonant frequency of said second cavity;

a third waveguide cavity being comprised of fifth and sixth inductive irises, and comprised of a single crystal high Tc superconductor, and being connected to and being a part of said main waveguide;

a third ferroelectric rod, characterized by said permittivity , being placed in said center of said third rectangular waveguide cavity the loaded resonant frequency of which being operated at said dominant mode;

a third means, connected to said third ferroelectric rod, to independently apply a bias electric field to said third ferroelectric rod to change the permittivity thereof and said resonant frequency of said third cavity;

a second waveguide section being connected to and providing a separation between said second and said third waveguide cavities and being typically one quarter of a guide wavelength long, at an operating frequency of the filter, and being a part of said main waveguide;

a fourth waveguide cavity being comprised of seventh and eighth inductive irises, and comprised of a single crystal high Tc superconductor, and being connected to and being a part of said main waveguide;

a fourth ferroelectric rod, characterized by said permittivity, being placed in said center of said fourth rectangular waveguide cavity the loaded resonant frequency of which being operated at said dominant mode;

a fourth means, connected to said fourth ferroelectric rod, to independently apply a bias electric field to said fourth ferroelectric rod to change the permittivity thereof and said resonant frequency of said fourth cavity;

a third waveguide section connected and providing a separation between said third and said fourth waveguide cavities and being typically one quarter of a guide wavelength long, at an operating frequency of the filter, and being a part of said main waveguide;

a fifth waveguide cavity being comprised of ninth and tenth inductive irises, and comprised of a single crystal high Tc superconductor, and being connected to and being a part of said main waveguide;

a fifth ferroelectric rod, characterized by said permittivity, being placed in the center of said fifth waveguide cavity the loaded resonant frequency of which being operated at said dominant mode;

a fifth means, connected to said fifth ferroelectric rod, to independently apply a bias to said fifth ferroelectric rod to change the permittivity thereof and said resonant frequency of said fifth cavity;

a fourth waveguide section being connected to and providing a separation between said fourth and said fifth waveguide cavities being typically one quarter of a guide wavelength long, at an operating frequency of the filter, and being a part of said main waveguide;

said rectangular waveguide sections, flanges and irises comprised of a single crystal high Tc superconductor;

said rectangular waveguide flanges being connected to said input and said output of said main waveguide respectively;

an output of a microprocessor, being connected to each voltage source, to independently control said levels of bias voltages to said first, second, third, fourth and fifth ferroelectric rods; and means, with which said tunable filter is associated, to keep said rectangular cavity filter at a constant high Tc superconducting temperature appropriately above said Curie temperature of the ferroelectric rods.

8. An RF tunable filter of claim 7;

each said cavity and each said waveguide section is comprised of a reduced height waveguide; and a flared waveguide each being connected at said input and at said output of the said filter respectively.

9. An RF tunable filter of claim 7 wherein said high Tc superconductor being YBCO.

10. A high Tc superconducting RF tunable filter having first through fourth cylindrical cavities, ferroelectric rods whose permittivity is dependent on a bias electric field applied thereto and having a Curie temperature, said filter having first through fifth coaxial cables, first through fourth sets of nuts and screws, a single crystal high Tc superconductor, a dominant resonant frequency, first through fourth inputs and outputs, centers and comprising of;

said first cylindrical cavity;

said first coaxial cable being connected to said first cylindrical cavity input;

said first ferroelectric rod, characterized by said permittivity, being placed at said center of said first cylindrical cavity and being operated at said dominant resonant frequency;

a first set of a nut and a screw disposed on top of said first ferroelectric rod to keep said ferroelectric rod in place in said first cylindrical cavity;

first means, connected to the first ferroelectric rod, to independently apply a bias electric field to said first ferroelectric rod to change the permittivity thereof and said resonant frequency of said first cylindrical cavity;

said second cylindrical cavity;

said first output of said first cylindrical cavity being fed to said second cylindrical cavity said second input through a said second coaxial cable;

a second ferroelectric rod, characterized by said permittivity, being placed at said center of said second cylindrical cavity operated at said dominant mode resonant frequency;

said second set of a nut and a screw disposed on top of said second ferroelectric rod to keep said ferroelectric rod in place in said second cylindrical cavity;

a second means, connected to said second ferroelectric rod, to independently apply a bias electric field to said second ferroelectric rod to change the permittivity thereof and said resonant frequency of said second cylindrical cavity;

said third cylindrical cavity; said second output of said second cylindrical cavity being fed to said third cylindrical cavity said third input through said third coaxial cable;

said third ferroelectric rod, characterized by said permittivity, being placed at said center of said third cylindrical cavity operated at said dominant mode resonant frequency;

said third set of a nut and a screw disposed on top of said third ferroelectric rod to keep said ferroelectric rod in place in said third cylindrical cavity;

a third voltage means, connected to third ferroelectric rod, to independently apply a bias electric field to said third ferroelectric rod to change the permittivity thereof and said resonant frequency of said third cylindrical cavity;

said fourth cylindrical cavity;

said third output of said third cylindrical cavity being fed to said fourth cylindrical cavity said fourth input through said fourth coaxial cable;

said fourth ferroelectric rod, having said permittivity, being placed at said center of said fourth cylindrical cavity operated at said dominant mode resonant frequency; said fourth set of a nut and a screw disposed on top of said fourth ferroelectric rod to keep said ferroelectric rod in place in said fourth cylindrical cavity;

said fifth coaxial cable being connected to said fourth cylindrical cavity said fourth output;

a fourth means, connected to said fourth ferroelectric rod, to independently apply a bias electric field to said fourth ferroelectric rod to change the permittivity thereof and said resonant frequency of said fourth cylindrical cavity;

said bias voltages of said four ferroelectric rods being synchronized to make the changed resonant frequencies of said four cylindrical cavities same at all times;

each said cavity comprised of a single crystal high Tc superconductor;

means, with which the tunable filter being associated, for keeping said cylindrical cavity filter at a constant high Tc superconducting temperature appropriately above the Curie temperature of said ferroelectric rods; and an output of a microprocessor, connected to each bias voltage source, to individually control said bias voltages of said first, second, third and fourth ferroelectric rods.

11. An RF tunable filter having first through fourth cylindrical cavities, ferroelectric rods whose permittivity is dependent on a bias electric field applied thereto and having a Curie temperature, said filter having first through fifth coaxial cables, first through fourth sets of nuts and screws, a dominant resonant frequency, inputs and outputs, centers and comprising of:

said first cylindrical cavity;

said first coaxial cable being connected to said first cylindrical cavity input;

said first ferroelectric rod, characterized by said permittivity, and being placed at said center of said first cylindrical cavity and being operated in said dominant resonant frequency;

a first set of a nut and a screw disposed on top of said first ferroelectric rod to keep said ferroelectric rod in place in said first cylindrical cavity;

a first means, connected to said first ferroelectric rod, to independently apply a bias electric field to said first ferroelectric rod to change the permittivity thereof and said resonant frequency of said first cylindrical cavity;

said second cylindrical cavity;

said output of said ,first cylindrical cavity being fed to said second cylindrical cavity said second input through a said second coaxial cable;

said second ferroelectric rod, characterized by said permittivity, and being placed at said center of said second cylindrical cavity and being operated at said dominant mode resonant frequency;

said second set of a nut and a screw disposed on top of said second ferroelectric rod to keep said ferroelectric rod in place in said second cylindrical cavity;

a second means, connected to said second ferroelectric rod, to independently apply a bias electric field to said second ferroelectric rod to change the permittivity thereof and said resonant frequency of said second cylindrical cavity;

a third cylindrical cavity;

said second output of said second cylindrical cavity being fed to said third cylindrical cavity said third input through said third coaxial cable;

said third ferroelectric rod, characterized by said permittivity, and being placed at said center of said third cylindrical cavity and being operated at said dominant mode resonant frequency;

said third set of a nut and a screw disposed on top of said third ferroelectric rod to keep said ferroelectric rod in place in said third cylindrical cavity;

a third voltage means, connected to said third ferroelectric rod, to independently apply a bias electric field to said third ferroelectric rod to change the permittivity thereof and said resonant frequency of said third cylindrical cavity;

a fourth cylindrical cavity;

said output of said third cylindrical cavity being fed to said fourth cylindrical cavity said fourth input through said fourth coaxial cable;

said fourth ferroelectric rod, characterized by said permittivity, and being placed at said center of said fourth cylindrical cavity and being operated at said dominant mode resonant frequency;

said fourth set of a nut and a screw disposed on top of said fourth ferroelectric rod to keep said ferroelectric rod in place in said fourth cylindrical cavity;

a fourth means, connected to said fourth ferroelectric rod, to independently apply a bias electric field to said fourth ferroelectric rod to change the permittivity thereof and said resonant frequency of said fourth cylindrical cavity;

said bias voltages of said four ferroelectric rods being synchronized to make the changed resonant frequencies of said four cylindrical cavities same at all times;

means, with which said tunable filter being associated, for keeping said cylindrical filter at a constant temperature appropriately above said Curie temperature of said ferroelectric rods; and an output of a microprocessor, connected to each bias voltage source, to individually control said bias voltages of said first, second, third and fourth ferroelectric rods.

12. A high Tc superconducting RF band pass broadband, staggered tunable filter having normal height and reduced height rectangular waveguides and waveguide cavities, ferroelectric rods whose permittivity is dependent on a bias electric field applied thereto and having a Curie temperature, said filter having first through tenth irises, flanges, an operating frequency, a dominant mode, a loaded resonant frequency, an input, an output, centers, and comprising of:

a main rectangular waveguide comprised of a single crystal high Tc superconductor;

said first rectangular waveguide cavity comprised of first and second inductive irises and comprised of a single crystal high Tc superconductor, and being connected to and being a part of said main waveguide;

said first ferroelectric rod, characterized by said permittivity, being placed in said center of said first rectangular waveguide cavity a first loaded resonant frequency of which being operated at said dominant mode;

a first means, connected to first ferroelectric rod, to independently apply a bias electric field to said first ferroelectric rod to change the permittivity thereof and said first resonant frequency of said first cavity;

said second rectangular waveguide cavity comprised of third and fourth inductive irises and comprised of a single crystal high Tc superconductor,and being connected to and being a part of said main waveguide;

said second ferroelectric rod, characterized by said permittivity, and being placed in said center of said second rectangular waveguide cavity a loaded second resonant frequency of which being operated at said dominant mode;

a first waveguide section being connected to and providing a separation between said first and said second waveguide cavities being typically one quarter of a guide wavelength long, at an operating frequency of the filter, and being a part of said main waveguide;

said second rectangular cavity being tuned to said dominant mode second resonant frequency appropriately staggered relative to the first resonant frequency of said first cavity;

a second means, connected to said second ferroelectric rod, to independently apply a bias electric field to said second ferroelectric rod to change the permittivity thereof and said second resonant frequency of said second cavity;

said third rectangular waveguide cavity being comprised of fifth and sixth inductive irises, and comprised of a single crystal high Tc superconductor, and being connected to and being a part of said main waveguide;

said third ferroelectric rod, characterized by said permittivity, being placed in said center of said third rectangular waveguide cavity a loaded third resonant frequency of which being operated at said dominant mode;

a third means, connected to said third ferroelectric rod, to independently apply a bias electric field to said third ferroelectric rod to change the permittivity thereof and said third resonant frequency of said third cavity;

a second waveguide section being connected to and providing a separation between said second and said third waveguide cavities being typically one quarter of a guide wavelength long, at an operating frequency of the filter, and being a part of said main waveguide;

said third rectangular cavity being tuned to said dominant mode third resonant frequency appropriately staggered relative to said second resonant frequency;

a fourth waveguide cavity being comprised of seventh and eighth inductive irises, and comprised of a single crystal high Tc superconductor, and being connected to and being a part of said main waveguide;

said fourth ferroelectric rod, characterized by said permittivity, being placed in said center of said fourth rectangular waveguide cavity a loaded fourth resonant frequency of which being operated at said dominant mode;

a fourth means, connected to said fourth ferroelectric rod, to independently apply a bias electric field to said fourth ferroelectric rod to change the permittivity thereof and said fourth resonant frequency of said fourth cavity;

a third waveguide section connected to and providing a separation between said third and said fourth waveguide cavities and being typically one quarter of a guide wavelength long, at an operating frequency of the filter, and being a part of said main waveguide;

said fourth rectangular cavity being tuned to said dominant mode fourth resonant frequency appropriately staggered relative to said third resonant frequency;

a fifth waveguide cavity being comprised of ninth and tenth inductive irises, and comprised of a single crystal high Tc superconductor, and being connected to and being a part of said main waveguide;

said fifth ferroelectric rod, characterized by said permittivity, being placed in said center of said fifth waveguide cavity a loaded fifth resonant frequency of which being operated at said dominant mode;

a fifth means, connected to said fifth ferroelectric rod, to independently apply a bias to fifth ferroelectric rod to change the permittivity thereof and said fifth resonant frequency of said fifth cavity;

a fourth waveguide section being connected to and providing a separation between said fourth and said fifth waveguide cavities and being typically one quarter of a guide wavelength long, at an operating frequency of the filter, and being a part of said main waveguide;

said fifth rectangular cavity being tuned to the dominant mode fifth resonant frequency appropriately staggered relative to said fourth resonant frequency of fourth cavity;

said rectangular waveguide sections, flanges and irises comprised of a single crystal high Tc superconductor;

said rectangular waveguide flanges being connected to said input and said output of said main waveguide;

an output of a microprocessor, being connected to each voltage source, to independently control said levels of bias voltages to said first, second, third, fourth and fifth ferroelectric rods;

said respective bias voltages of said five ferroelectric rods being synchronized to make the changed resonant frequencies of said five rectangular cavities staggered by predetermined amounts at all times, means, with which said tunable filter is associated, to keep said rectangular cavity filter at a constant high Tc superconducting temperature appropriately above said Curie temperature of said ferroelectric rods.

13. An RF tunable broadband filter of claim 12 wherein the single crystal high Tc superconductor being YBCO.

14. An RF tunable band pass filter having first through fifth rectangular waveguide cavities, first through fifth ferroelectric rods whose permittivity is dependent on a bias electric field applied thereto and having a Curie temperature, said filter having first through tenth irises, flanges, an operating frequency, a loaded resonant frequency, an input, an output, centers, a dominant mode and comprising of:

a main rectangular waveguide;

said first rectangular waveguide cavity comprised of said first and second inductive-irises and being connected to and being a part of said main waveguide;

said first ferroelectric rod, characterized by said permittivity, being placed in said center of said first rectangular waveguide cavity the loaded resonant frequency of which is operated at the dominant mode;

a first means, connected to first ferroelectric rod, to independently apply a bias electric field to said first ferroelectric rod to change the permittivity thereof and said resonant frequency of said first cavity;

said second rectangular waveguide cavity comprised of said third and fourth inductive irises and being connected to and being a part of said main waveguide;

said second ferroelectric rod, characterized by said permittivity, being placed in said center of said second rectangular waveguide cavity the loaded resonant frequency of which being operated at said dominant mode;

a first waveguide section being connected to and providing a separation between said first and said second waveguide cavities being typically one quarter of a guide wavelength long, at an operating frequency of the filter, and being a part of said main waveguide;

a second means, connected to said second ferroelectric rod, to independently apply a bias electric field to said second ferroelectric rod to change the permittivity thereof and said resonant frequency of said second cavity;

said third waveguide cavity being comprised of said fifth and sixth inductive irises being connected to and being a part of said main waveguide;

said third ferroelectric rod, characterized by said permittivity, being placed in said center of said third rectangular waveguide cavity the loaded resonant frequency of which being operated at said dominant mode;

a third means, connected to said third ferroelectric rod, to independently apply a bias electric field to said third ferroelectric rod to change the permittivity thereof and said resonant frequency of said third cavity;

a second waveguide section being connected to and providing a separation between said second and said third waveguide cavities being typically one quarter of a guide wavelength long, at an operating frequency of the filter, and being a part of said main waveguide;

said fourth waveguide cavity being comprised of said seventh and eighth inductive irises and being connected to and being a part of said main waveguide;

a fourth ferroelectric rod, characterized by said permittivity, being placed in said center of said fourth rectangular waveguide cavity the loaded resonant frequency of which being operated at the dominant mode;

a fourth means, connected to said fourth ferroelectric rod, to independently apply a bias electric field to said fourth ferroelectric rod to change the permittivity thereof and said resonant frequency of said fourth cavity;

a third waveguide section connected to and providing a separation between said third and said fourth waveguide cavities being typically one quarter of a guide wavelength long, at an operating frequency of the filter, and being a part of said main waveguide;

said fifth waveguide cavity being comprised of said ninth and tenth inductive irises connected to and being a part of said main waveguide;

said fifth ferroelectric rod, characterized by said permittivity, being placed in said center of said fifth waveguide cavity the loaded resonant frequency of which being operated at said dominant mode;

a fifth means, connected to said fifth ferroelectric rod, to independently apply a bias to fifth ferroelectric rod to change the permittivity thereof and said resonant frequency of said fifth cavity;

a fourth waveguide section being connected to and providing a separation between said fourth and said fifth waveguide cavities being typically one quarter of a guide wavelength long, at an operating frequency of the filter, and being a part of said main waveguide;

said rectangular waveguide flanges being connected to said input and said output of said main waveguide respectively;

an output of a microprocessor, being connected to each voltage source, to independently control the level of bias voltages to said first, second, third, fourth and fifth ferroelectric rods; and means, with which said tunable filter being associated, to keep said tunable band pass waveguide cavity filter at a constant temperature appropriately above said Curie temperature of said ferroelectric rods.

15. A high Tc superconducting RF tunable band pass filter having first through fifth rectangular waveguide cavities, first through fifth ferroelectric rods whose permittivity is dependent on a bias electric field applied thereto and having a Curie temperature, said filter having a single crystal dielectric material, a single crystal high Tc superconductor, first through tenth irises, flanges, an operating frequency, a loaded resonant frequency, an input, an output, centers, a dominant mode and comprising of:

a main rectangular waveguide comprised of a single crystal dielectric material having interior conducting surfaces on which are deposited a film of a single crystal high Tc superconductor;

said first rectangular waveguide cavity comprised of first and second inductive irises and comprised of a single crystal dielectric material having interior conducting surfaces on which are deposited a film of a high Tc superconductor, and being connected to and being a part of said main waveguide;

said first ferroelectric rod, characterized by said permittivity, and being placed in said center of said first rectangular waveguide cavity the loaded resonant frequency of which is operated at said dominant mode;

a first means to independently apply a bias electric field to said first ferroelectric rod to change the permittivity thereof and said resonant frequency of said first cavity;

said second rectangular waveguide cavity comprised of said third and fourth inductive irises and comprised of a single crystal dielectric material having interior conducting surfaces on which are deposited a film of a high Tc superconductor, and being connected to and being a part of said main waveguide;

said second ferroelectric rod, characterized by said permittivity, being placed in said center of said second rectangular waveguide cavity the loaded resonant frequency of which is operated at said dominant mode;

a second means, connected to said second ferroelectric rod, to independently apply a bias electric field to said second ferroelectric rod to change the permittivity thereof and said resonant frequency of said second cavity;

a first waveguide section being connected and providing a separation between said first and said second waveguide cavities being typically one quarter of a guide wavelength long at an operating frequency of the filter and being a part of said main waveguide;

said third waveguide cavity being comprised of said fifth and sixth inductive irises, and comprised of a single crystal dielectric material having interior conducting surfaces on which are deposited a film of a high Tc superconductor, and being connected to and being a part of said main waveguide;

said third ferroelectric rod, characterized by said permittivity being placed in said center of said third rectangular waveguide cavity the loaded resonant frequency of which is operated at said dominant mode;

a third means, connected to said third ferroelectric rod, to independently apply a bias electric field to said third ferroelectric rod to change the permittivity thereof and said resonant frequency of said third cavity;

a second waveguide section being connected to and providing a separation between said second and said third waveguide cavities being typically one quarter of a guide wavelength long at an operating frequency of the filter and being a part of said main waveguide;

said fourth waveguide cavity being comprised of said seventh and eighth inductive irises, comprised of a single crystal dielectric material having interior conducting surfaces on which are deposited a film of a single crystal high Tc superconductor, and being connected to and being a part of said main waveguide;

said fourth ferroelectric rod, characterized by said permittivity being placed in said center of said fourth rectangular waveguide cavity the loaded resonant frequency of which is operated at the dominant mode;

a fourth means, connected to said fourth ferroelectric rod, to independently apply a bias electric field to said fourth ferroelectric rod to change the permittivity thereof and said resonant frequency of said fourth cavity;

a third waveguide section connected and providing a separation between said third and said fourth waveguide cavities being typically one quarter of a guide wavelength long at an operating frequency of the filter and being a part of said main waveguide;

said fifth waveguide cavity being comprised of said ninth and tenth inductive irises, and comprised of a single crystal dielectric material having interior conducting surfaces on which are deposited a film of a single crystal high Tc superconductor, and being connected to and being a part of said main waveguide;

said fifth ferroelectric rod, characterized by said permittivity and being placed in said center of said fifth waveguide cavity the loaded resonant frequency of which being operated at said dominant mode;

a fifth means, connected to said fifth ferroelectric rod, to independently apply a bias to fifth ferroelectric rod to change the permittivity thereof and said resonant frequency of said fifth cavity;

a fourth waveguide section being connected and providing a separation between fourth and said fifth waveguide cavities being typically one quarter of a guide wavelength long at an operating frequency of the filter and being a part of said main waveguide;

said rectangular waveguide sections, flanges and irises comprised of a single crystal dielectric material having interior conducting surfaces on which are deposited a film of single crystal high Tc superconductor;

said rectangular waveguide flanges being connected to said input and said output of said main waveguide respectively;

an output of a microprocessor, being connected to each voltage source, to independently control said levels of bias voltages to said first, second, third fourth and fifth ferroelectric rods; and means, with which said tunable filter being associated, to keep said tunable band pass waveguide cavity filter at a high Tc superconducting temperature appropriately above said Curie temperature of said ferroelectric rods.

16. A high Tc superconducting RF tunable band reject filter having first through third rectangular waveguide cavities, first through third ferroelectric rods whose permittivity is dependent on a bias electric field applied thereto and having a Curie temperature, an operating frequency, said filter having flanges, first through third irises, an input, an output, centers, a dominant mode, a loaded resonant frequency and comprising of:

A main rectangular waveguide section, having a broad wall, comprised of a single crystal high Tc superconductor;

said first rectangular waveguide cavity comprised of a single crystal high Tc superconductor, having a first inductive iris being connected to said broad wall of and being separate from said main waveguide;

said first ferroelectric rod, characterized by said permittivity and being placed in said center of said first rectangular waveguide cavity the loaded resonant frequency of which is operated at said dominant mode;

a first means, connected to said first ferroelectric rod, to independently apply a bias electric field to said first ferroelectric rod to change the permittivity thereof and said resonant frequency of said first cavity;

said second rectangular waveguide cavity being comprised of a single crystal high Tc superconductor, having said second inductive iris being connected to said broad wall of and being separate from said main waveguide;

said second ferroelectric rod, characterized by said permittivity being placed in said center of said second rectangular waveguide cavity the loaded resonant frequency of which is operated at said dominant mode;

a second means, connected to said second ferroelectric rod, to independently apply a bias electric field to said second ferroelectric rod to change the permittivity thereof and said resonant frequency of said second cavity;

a first rectangular waveguide section connected and providing a separation of a quarter of a guide wavelength long, at an operating frequency of the filter, between said first and said second waveguide cavities and being a part of said main waveguide;

said third rectangular waveguide cavity being comprised of a single crystal high Tc superconductor, having said third inductive iris being connected to said broad wall of and separate from said main waveguide;

said third ferroelectric rod, having said permittivity being placed in said center of said third rectangular waveguide cavity the loaded resonant frequency of which is operated at said dominant mode;

a third means, connected to said third ferroelectric rod, to independently apply a bias electric field to said third ferroelectric rod to change the permittivity thereof and said resonant frequency of said third cavity;

a second rectangular waveguide section being connected and providing a separation of a quarter of a guide wavelength long, at an operating frequency of the filter, between said second and said third waveguide cavities and being a part of said main waveguide;

said rectangular waveguide flanges being connected to said main waveguide at said input and said output respectively;

an output of a microprocessor, being connected to each voltage source, to independently control the level of bias voltages to said first, second and third ferroelectric rods; and means, with which said tunable filter being associated, to keep said tunable band reject waveguide cavity filter at a high Tc superconducting temperature appropriately above said Curie temperature of said ferroelectric rods.

17. An RF band pass broadband, staggered tunable filter having normal height and reduced height rectangular waveguides and waveguide cavities, ferroelectric rods whose permittivity is dependent on a bias electric field applied thereto and having a Curie temperature, said filter having first through tenth irises, flanges, an operating frequency, a loaded resonant frequency, an input, an output, centers, a dominant mode and comprising of:

a main rectangular waveguide;

a first rectangular waveguide cavity comprised of said first and second inductive irises being connected to and being a part of said main waveguide;

a first ferroelectric rod, characterized by said permittivity, being placed in said center of said first rectangular waveguide cavity a first loaded resonant frequency of which being operated at the dominant mode;

a first means, connected to first ferroelectric rod, to independently apply a bias electric field to said first ferroelectric rod to change the permittivity thereof and said first resonant frequency of said first cavity;

a second rectangular waveguide cavity comprised of said third and fourth inductive irises being connected to and being a part of said main waveguide;

a second ferroelectric rod, characterized by said permittivity, being placed in said center of said second rectangular waveguide cavity a loaded second resonant frequency of which being operated at the dominant mode;

a first waveguide section being connected to and providing a separation between said first and said second waveguide cavities being typically one quarter of a guide wavelength long, at an operating frequency of the filter, and being a part of said main waveguide;

said second rectangular cavity being tuned to said dominant mode second resonant frequency appropriately staggered relative to said first resonant frequency of said first cavity;

a second means, connected to said second ferroelectric rod, to independently apply a bias electric field to said second ferroelectric rod to change the permittivity thereof and said second resonant frequency of said second cavity;

a third waveguide cavity being comprised of said fifth and sixth inductive irises being connected to and being a part of said main waveguide;

a third ferroelectric rod, characterized by said permittivity, being placed in the center of said third rectangular waveguide cavity a loaded third resonant frequency of which being operated at said dominant mode;

a third means, connected to said third ferroelectric rod, to independently apply a bias electric field to said third ferroelectric rod to change the permittivity thereof and said third resonant frequency of said third cavity;

a second waveguide section being connected and providing a separation between said second and said third waveguide cavities and being typically one quarter of a guide wavelength long, at an operating frequency of the filter, and being a part of said main waveguide;

said third rectangular cavity being tuned to said dominant mode third resonant frequency appropriately staggered relative to said second resonant frequency;

a fourth waveguide cavity being comprised of seventh and eighth inductive irises being connected to and being a part of said main waveguide;

a fourth ferroelectric rod, characterized by said permittivity, being placed in said center of said fourth rectangular waveguide cavity a loaded fourth resonant frequency of which being operated at said dominant mode;

a fourth means, connected to said fourth ferroelectric rod, to independently apply a bias electric field to said fourth ferroelectric rod to change the permittivity thereof and said fourth resonant frequency of said fourth cavity;

a third waveguide section connected and providing a separation between said third and said fourth waveguide cavities and being typically one quarter of a guide wavelength long, at an operating frequency of the filter, and being a part of said main waveguide;

said fourth rectangular cavity being tuned to said dominant mode third resonant frequency appropriately staggered relative to said third resonant frequency;

a fifth waveguide cavity being comprised of ninth and tenth inductive irises being connected to and being a part of said main waveguide;

a fifth ferroelectric rod, characterized by said permittivity, being placed in said center of said fifth waveguide cavity a loaded fifth resonant frequency of which being operated at said dominant mode;

a fifth means, connected to said fifth ferroelectric rod, to independently apply a bias to fifth ferroelectric rod to change the permittivity thereof and said fifth resonant frequency of said fifth cavity;

a fourth waveguide section being connected to and providing a separation between said fourth and said fifth waveguide cavities and being typically one quarter of a guide wavelength long, at an operating frequency of the filter, and being a part of said main waveguide;

said fifth rectangular cavity being tuned to said dominant mode fifth resonant frequency appropriately staggered relative to said fourth resonant frequency of fourth cavity;

said rectangular waveguide flanges being connected to said input and said output of said main waveguide respectively;

an output of a microprocessor, being connected to each voltage source, to independently control said levels of bias voltages to said first, second, third, fourth and fifth ferroelectric rods;

said bias voltages of said five ferroelectric rods being synchronized to make the changed resonant frequencies of said five rectangular cavities staggered by predetermined amounts at all times, means, with which said tunable filter is associated, to keep said rectangular cavity filter at a constant temperature appropriately above said Curie temperature of the ferroelectric rods.

18. An RF tunable filter of claim 17;

each said cavity and each said waveguide section is comprised of a reduced height waveguide; and a respective flared waveguide each being connected at said input and at said output of the said filter.

* * * * *

UNITED STATES PATENT AND TRADEMARK OFFICE

CERTIFICATE OF CORRECTION

PATENT NO. : 5,459,123

DATED : October 17, 1995

INVENTOR(S) : Satyendranath Das

It is certified that error appears in the above-indentified patent and that said Letters Patent is hereby corrected as shown below:

In the drawing:

Delete Figure 3, and substitute therefor the Drawing Sheet, consisting of Figure 3, as shown on the attached page.

Signed and Sealed this

Second Day of January, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,459,123
DATED : Oct. 17, 1995
INVENTOR(S) : Satyendranath Das

It is certified that error appears in the above-indentified patent and that said Letters Patent is hereby corrected as shown below:

Column 3, para 1, line 3.

- - 10 - - is inserted between "screw" and "and".

Column 3, para 6, line 16.

"27" is replaced by - - 37 - -.

Column 4, para 4, line 4.

"(" is deleted. "56 " between "56,(" and "76" is replaced by - - 66 - -.

Signed and Sealed this

Twenty-first Day of May, 1996

Bruce Lehman

*Attest:*

BRUCE LEHMAN

*Attesting Officer*

*Commissioner of Patents and Trademarks*